United States Patent [19]

Junck et al.

[11] 3,997,007

[45] Dec. 14, 1976

[54] IMPLEMENT POSITIONING HYDRAULIC CONTROL SYSTEM

[75] Inventors: John A. Junck, Joliet; Larry W. Lorimor, Crest Hill, both of Ill.

[73] Assignee: Caterpillar Tractor Co., Peoria, Ill.

[22] Filed: July 14, 1975

[21] Appl. No.: 595,819

[52] U.S. Cl. ..... 172/804; 37/DIG. 10; 91/411 R; 91/413; 60/484; 60/486

[51] Int. Cl.[2] ..... E02F 3/76

[58] Field of Search ..... 172/804, 809; 37/DIG. 7, DIG. 10; 91/411 R, 413, 414; 60/421, 422, 484, 486; 137/101

[56] References Cited

UNITED STATES PATENTS

| | | | |
|---|---|---|---|
| 1,999,834 | 4/1935 | Ernst | 137/101 |
| 3,350,986 | 11/1967 | Berta et al. | 91/414 |
| 3,700,044 | 10/1972 | Berg | 91/413 X |
| 3,705,631 | 12/1972 | Seaberg | 91/413 X |
| 3,774,696 | 11/1973 | Horsch | 91/412 X |
| 3,795,280 | 3/1974 | Casey | 91/413 X |
| 3,854,380 | 12/1974 | Casey | 91/413 |

*Primary Examiner*—Edgar W. Geoghegan
*Attorney, Agent, or Firm*—Charles E. Lanchantin, Jr.

[57] ABSTRACT

A hydraulic control system is disclosed for selectively directing fluid to a pair of reciprocable jacks connectably disposed intermediate a frame and an implement such as a bulldozer blade for tilting and tipping the blade relative to the frame. The control system includes a fluid supply source, a flow divider valve which is in fluid communication with the supply source for providing equal flow to a pair of outlet paths, a first control valve arrangement for selectively communicating fluid from one of the outlet paths to either end of one of the jacks, and a second control valve arrangement for selectively communicating fluid from the other one of the outlet paths to either end of the other one of the jacks.

4 Claims, 6 Drawing Figures

TILT
TIP
46
44
74
76
10
62
14
64
78
80
86
82
90
66
32
30
176
130
68
70
72
222
174
220
184
84
88
58
60
128
184
RV
148
136
138
132
12
42
54
126
124
AUXIL. CIRCUITS
92
134
120
118
112
114
110
102
122
98
56
96
94
116
106
100
108
28
52
104
50
48

IMPLEMENT POSITIONING HYDRAULIC CONTROL SYSTEM

BACKGROUND OF THE INVENTION

It is known to pivotally mount a bulldozer blade or the like on the front end of the vehicle so that through selective manipulation of a pair of hydraulic tilt jacks connected to the blade at the opposite sides thereof its tilt and tip positions can be varied. At least one other lift jack is usually associated with the blade for changing its elevation. In order to permit easier and more responsive tilting or tipping of the blade, the hydraulic control system associated therewith should preferably have the capability to permit simultaneously coordinated operation of the tilt jacks for rapid tipping of the blade without affecting the tilt of the blade or simultaneously opposite coordinated movement thereof for tilting of the blade. A further desirable feature of the system is its flexibility to permit independent operation of the tilt jacks. For example, the bulldozer blade must frequently be rapidly positioned by manipulating the various levers while at the same time maneuvering the vehicle. This requires a high degree of dexterity and alertness on the part of the operator. Therefore, such control system should permit manually independent or simultaneous operation of the tilt jacks in order to minimize operational problems and to reduce operator fatigue.

Illustrative of the wide range of efforts to solve the many problems associated with varying the position of a bulldozer blade in U.S. Pat. No. 3,705,631 issued Dec. 12, 1972 to D. H. Seaberg. Unfortunately, while the fluid control system of the reference patent does allow simultaneous movement of the tilt jacks, it will not allow independent operation thereof. Because one jack feeds another, it is not possible to tilt the blade at a fully tipped condition. This deficiency results from one of the jacks being at the end of its stroke and adversely stopping flow to the other tilt jack. Another disadvantage of the referenced system is that it includes pilot operated check valves in the conduits leading to the tilt jacks to insure that the load on the blade will not cause the operationally affected tilt jack from extending or retracting faster than the system flow capability will allow. Such check valves add complexity and expense to the system.

Representative of another attempt to solve these problems is the control circuit shown in U.S. Pat. No. 3,774,696 issued Nov. 27, 1973 to R. Horsch. Such control circuit incorporates valving for connecting the tilt jacks in series or in parallel for respectively tilting or tipping the blade, but on the other hand lacks flow control so that the blade loading can adversely influence the desired positioning thereof. For example, when tipping the blade under load, there is no guarantee of equal fluid flow to both jacks and, consequently, the blade can tilt during tipping so that additional blade manipulation is required of the operator to reorient it.

Another general problem involves the compatability and integration of the tilt jack circuitry with the associated lift jack circuitry. Since the lift jacks require a considerably higher flow demand than the tilt jacks, it is desirable to provide a pair of pumps with different volumetric capacities therefor. Consequently, if a relatively large pump and associated system valving is used for directing flow to the lift jacks, and a smaller pump is used with appropriate valving for delivering flow to the tilt jacks, it is desirable for reasons of operating economy to utilize flow from the smaller pump and tilt jack circuit to supplement the flow of the larger pump in order to permit faster response of the lift jacks.

SUMMARY AND OBJECTS OF THE INVENTION

Accordingly, it is an object of the present invention to provide an improved hydraulic control system for varying the position of an implement relative to a frame on which it is mounted, and which will permit simultaneously coordinated operation of a pair of tilt jacks associated therewith for tipping the implement or simultaneously opposite coordinated movement thereof for tilting it, and further to permit independent operation of the tilt jacks.

Another object of the invention is to provide such an improved hydraulic control system wherein tipping of the implement can be positively achieved within the stroke limitations of the tilt jacks without affecting the tilt thereof.

Another object of the invention is to provide a control system of the character described wherein it is further possible to tilt from a fully tipped position of the implement, or to tip from a fully tilted position thereof.

Another object of the invention is to integrate such an improved control system effectively with an associated circuit so that the fluid flow therefrom can be economically utilized therewith.

Other objects and advantages of the present invention, such as compatability of the control system with remotely disposed control console and intercommunicating pilot operating arrangement, will become more readily apparent upon reference to the accompanying drawings and following description

BRIEF DESCRIPTION OF THE BASIC EMBODIMENT

Figure 1:
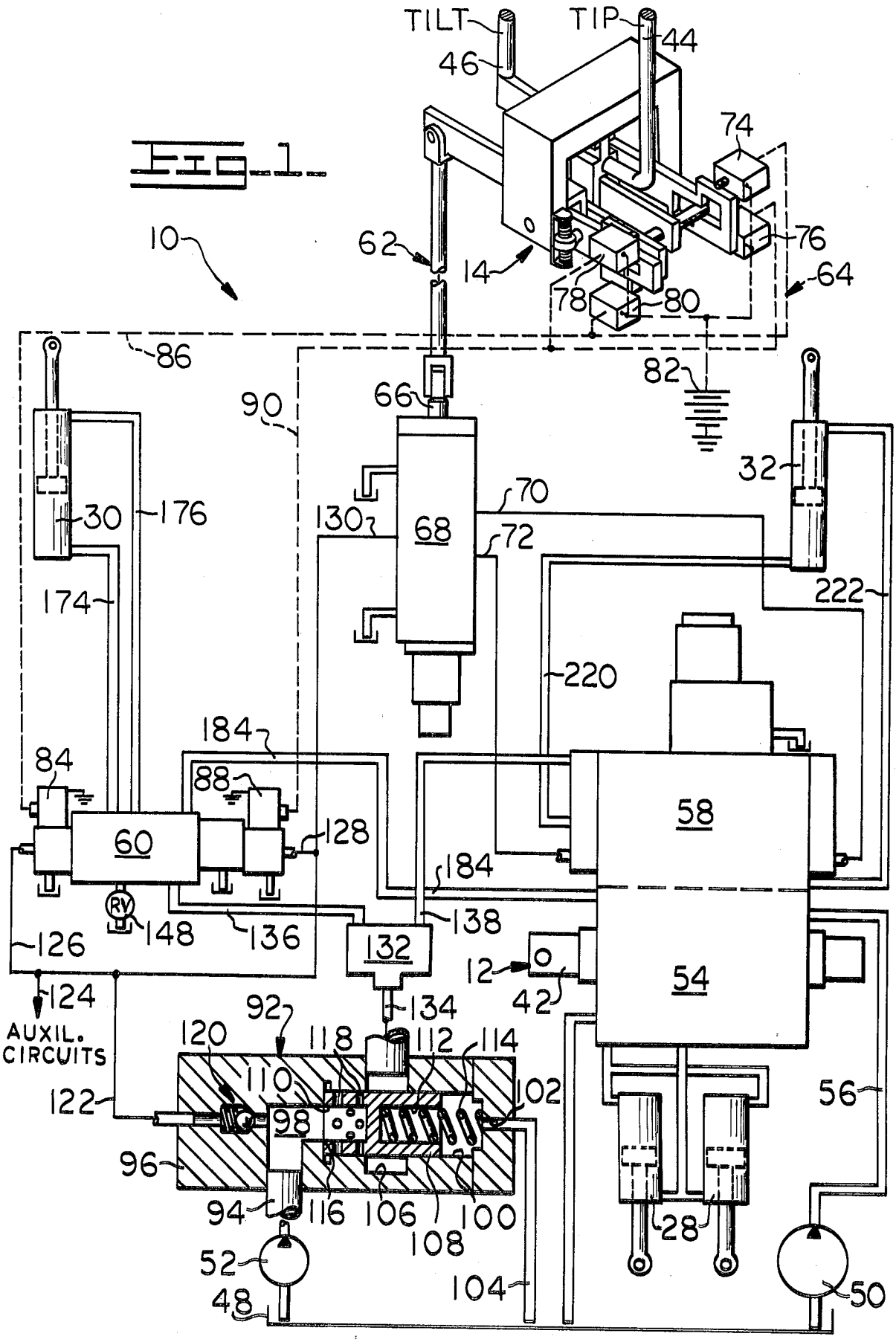
FIG. 1 is a schematic illustration of the implement positioning hydraulic control system of the present invention including a fragmentary elevational perspective view of a dual control mechanism associated therewith, and with the principal flow directing conduits illustrated as closely spaced parallel lines, with the hydraulic pilot signal conduits illustrated as single solid lines and with the electrical signal lines illustrated as single broken lines.
Figure 2:
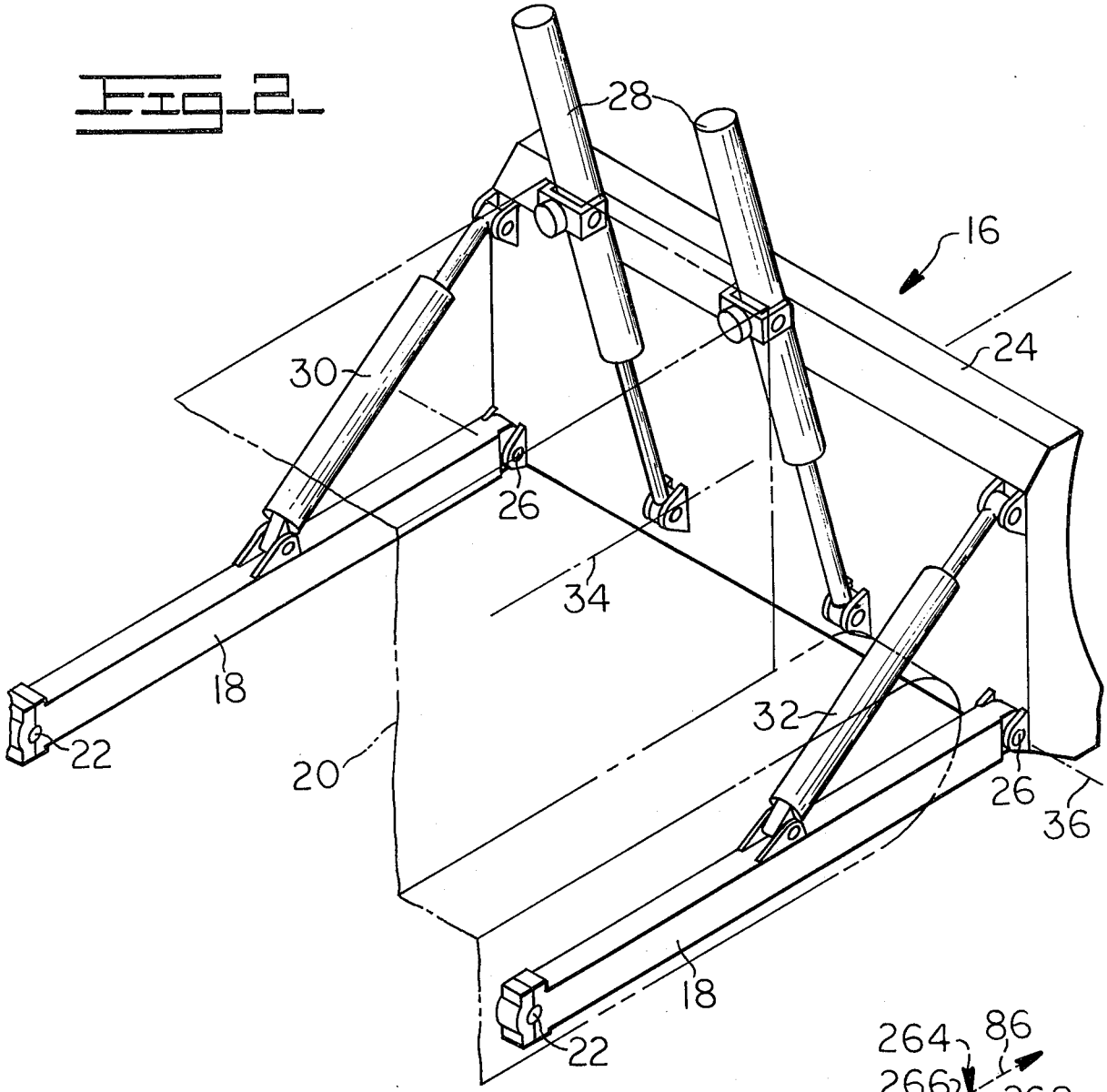
FIG. 2 is an elevational perspective view of a representative implement, such as a bulldozer blade, which is variably positioned by the hydraulic control system of the present invention and further illustrating in fragmentary phantom outline a representative vehicle on which the bulldozer blade is pivotally mounted.

Referring initially to FIG. 1 of the drawings, a hydraulic control system 10 is shown which is responsive to the manual manipulation of an implement elevation control mechanism 12 and a dual lever control mechanism 14 for respectively raising and lowering, and variably tilting and tipping an earthmoving implement such as a bulldozer 16. As best shown in FIG. 2, the bulldozer includes a frame or pair of push arms 18 mounted on the opposite sides of a vehicle 20 through a pair of universal connections 22, and a bulldozer blade 24 pivotally connected to the front of the arms as by a pair of universal connections 26. A pair of reversible primary motors or reciprocable hydraulic lift jacks 28 are coupled intermediate the vehicle and the blade for raising it and lowering it in the usual manner, and a pair of auxiliary reversible motors or reciprocable hydraulic tilt jacks 30 and 32 are mounted intermediate the arms and the blade for tilting or tipping it relative to the vehicle.

It should hereinafter be appreciated that in this application, tilting is the action of moving the bulldozer blade 24 about a horizontally arranged longitudinal axis 34 substantially perpendicular to the blade, whereas tipping is the action of moving the blade about a horizontally arranged transverse axis 36 substantially parallel to the blade. In this way simultaneous extension or retraction of the left and right tilt jacks 30 and 32 will cause forward or rearward tipping of the blade, respectively, whereas extension of the left tilt jack and/or retraction of the right tilt jack will cause the blade to tilt so that the right side is elevationally lowered with respect to the left side.

Figure 3:
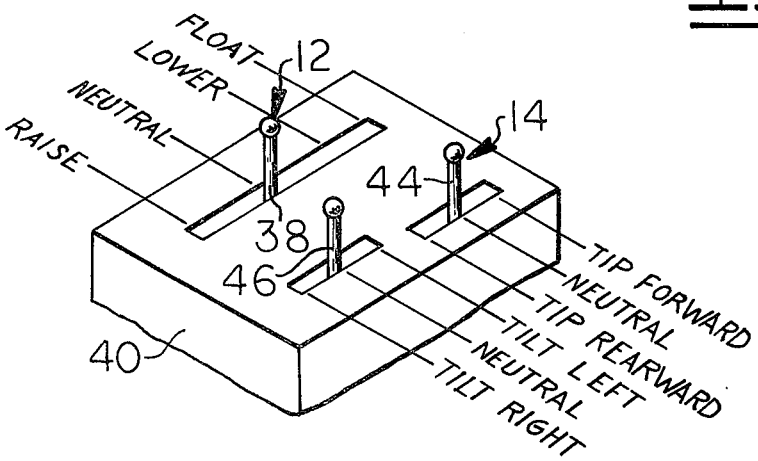
FIG. 3 is a fragmentary perspective elevational view of an operator control console including a lift jack control lever, and a pair of tilt-tip control levers for operating the hydraulic control system of FIG. 1.

As shown in FIG. 3, the elevation control mechanism 12 includes a manually positionable lift control lever 38 which is pivotally disposed in an operator's control console 40 and is arcuately movable into raise (R), neutral (N), lower (L) and float (F) positions in a normal manner. Selective movement of this control lever subsequently positions a lift control spool 42 in the hydraulic control system of FIG. 1 through appropriate connecting linkage of a conventional type, and not shown. On the other hand, the dual lever control mechanism 14 includes a first manually positionable tip control lever 44 and a second mechanically interrelated tilt control lever 46 mounted within the console. The tip control lever is arcuately movable into tip forward and tip rearward positions on either side of a central neutral or jack holding position, while the tilt control lever is movable in substantially the same arcuate manner into tilt left and tilt right positions away from its central neutral position.

More particularly, as illustrated in FIG. 1, the hydraulic control system 10 of the present invention includes a fluid supply reservoir 48 and a pair of positive displacement pumps connected thereto which have different volumetric capacities to define a relatively large pump 50 and a relatively small pump 52. The large pump directs fluid to a primary control valve 54 by way of an inlet conduit 56, so that manual movement of the lift control spool 42 within the valve will permit fluid delivery therefrom to the lift jacks 28.

At the same time, the small pump 52 generally communicates fluid to the tilt jacks 30 and 32, respectively, through a cooperatively associated pilot operated second control valve 58 and a solenoid actuated, pilot operated third control valve 60. Operation of the tilt jacks is achieved through selective manipulation of the dual lever control mechanism 14, which subsequently actuates a pair of control devices generally indicated at 62 and 64 for respectively actuating the second control valve 58 and the third control valve 60. Actuation of the first control device 62 effectively moves a valve spool 66 of a pilot control valve 68 to either of its operative positions, away from a central neutral position, for selectively directing pilot signals to a pilot line 70 or to a pilot line 72. One of these pilot signals subsequently positions the second control valve 58 to direct fluid selectively to one end of the right tilt jack 32.

In the instant example, the left tilt jack 30 is operated either in series or in parallel with the right tilt jack 32 because of the particular construction of the dual lever mechanism 14, which construction is disclosed in detail in copending U.S. Pat. application Ser. No. 595,820, filed July 14, 1975 to R. E. Utter, and assigned to the assignee of the present invention. It is sufficient in this application to appreciate that with operation of the first control device 62 the second control device 64 is also operated through the manual tripping of one of the four electrically operated switches indicated generally by the reference numerals 74, 76, 78 and 80. Tripping of either of the switches 74 or 80 allows an electric signal from an electric source 82 to be directed to a first solenoid valve 84 via a schematically illustrated first signal line 86, whereas tripping of either of the remaining two switches 76 or 78 similarly communicates an electric signal to a second solenoid valve 88 via a second signal line 90. The operation of either of these two solenoid valves permits pilot system pressure to operate the third control valve 60 and subsequently to allow delivery of operating fluid from the small pump 52 to the left tilt jack 30 for positioning thereof.

In accordance with one aspect of the invention, the hydraulic control system 10 includes a flow responsive valve 92 disposed in the path of a supply conduit 94 from the small pump 52. This valve has a valve body 96 with an inlet chamber 98 therein, an elongated cylindrical bore 100 opening on the chamber, an outlet passage 102 opening into the opposite end of the bore and which is in communication with the reservoir 48 through a drain conduit 104, and an outlet annulus 106 centrally opening on the bore. A relief spool 108 having a cylindrical inlet cavity 110 and a spring receiving cavity 112 opening on the opposite ends thereof is disposed for reciprocal movement in the bore, and a compression spring 114 biases the spool leftwardly to its closed position against an annular seat 116. The spool has a plurality of staggered passages 118 radially opening on the inlet cavity and the bore, so that with rightward movement of the spool such as would initially occur when a pressure setting of approximately 100 psi is reached in the inlet chamber, the staggered passages progressively open to permit fluid delivery to the outlet annulus. A spring-loaded check valve 120 is also disposed in the valve body intermediate the inlet chamber 98 and a main pilot supply line 122 to assure fluid flow to the pilot supply line, but to prevent reverse flow therefrom. In this way the flow responsive valve and check valve assure priority of flow and an operating pressure of approximately 100 psi in the pilot supply line for signalling purposes, before the remaining flow from the small pump is permitted to pass to the outlet annulus. While the pilot supply line does not normally exhibit a high fluid demand it is connected to other auxiliary circuits (not shown) through a branch conduit 124, as well as being connected with the opposite ends of the third control valve 60 via a branch conduit 126 and a branch conduit 128, and being centrally connected with the pilot control valve 68 via another branch conduit 130. With operation of the pilot control valve 68 either of the pilot lines 70 or 72 is pressurized to actuate either end of the second control valve 58 as briefly mentioned above. For a complete disclosure of such a pilot control valve reference is herein made to U.S. Patent Application Ser. No. 496,477 filed Aug. 12, 1974 by E. E. Latimer, and assigned to the assignee of the present invention.

In accordance with a major feature of the invention, a flow divider valve 132 is disposed in fluid communication with the outlet annulus 106 of the flow responsive valve 92 through a conduit 134. Such flow divider is constructed to divide the inlet stream into two equal outlet streams as, for example, the B50 model flow divider manufactured by Brand Hydraulics, Inc., of Omaha, Nebraska. Consequently, it divides flow equally to a branch conduit 136 and a branch conduit 138 even though the work being done by one of the outlet streams is much greater than the work being done by the other.

Figure 4:
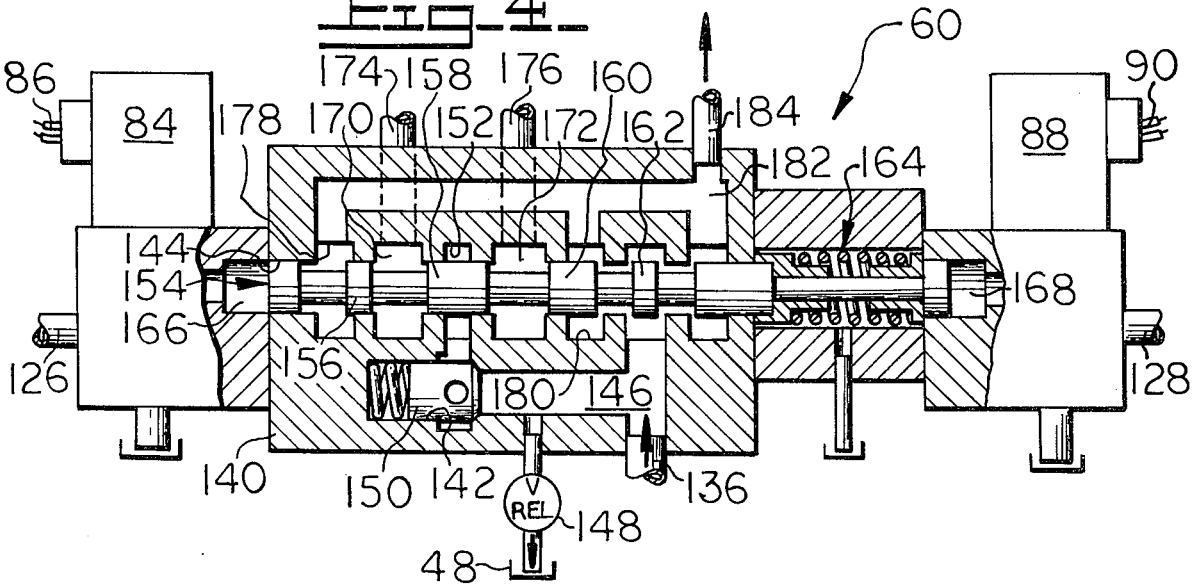
FIG. 4 is an enlarged view of the solenoid actuated, pilot-operated third control valve illustrated in FIG. 1 with portions thereof shown in section to better illustrate details of its construction.

In this way half of the flow of the small pump 52 is delivered by the branch conduit 136 from the flow divider 132 to the solenoid actuated, pilot operated third control valve 60, and reference is now made to FIG. 4 for details thereof. As is clearly illustrated, the open center type third control valve includes a valve body 140 having a pair of bores 142 and 144 formed therein which are in fluid communication with the branch conduit 136 through a branched inlet passage 146. A conventional pilot operated relief valve 148 is connected to the inlet passage to relieve fluid back to the reservoir 48 at a relief setting of approximately 2700 psi, and a conventional load check valve 150 is also disposed intermediate the inlet passage and an inlet annulus 152 opening on the main spool bore 144 to assure fluid flow solely thereto. A valve spool 154 having a plurality of axially spaced lands 156, 158, 160, and 162 is slidably mounted within the main spool bore and is adapted to be normally biased to a central hold position by a spring-loaded centering mechanism 164 of the usual type. With piloting movement of the valve spool in either direction therefrom as a result of actuation of the first solenoid valve 84 and admittance of pilot pressure from the branch conduit 126 to a pressure chamber 166, or actuation of the second solenoid valve 88 and admittance of pilot pressure from the opposite branch conduit 128 to a pressure chamber 168, the central valve land 158 is axially positioned to permit fluid flow from the inlet passage respectively to a first outlet annulus 170 or a second outlet annulus 172. Since the first outlet annulus is in fluid communication with a conduit 174 leading to the head end of the lift jack 30 shown in FIG. 1, it is caused to extend with pressurizing thereof. Similarly, the same jack will retract when the second annulus is appropriately pressurized because the rod end thereof is connected to the second outlet annulus through a conduit 176.

In accordance with another feature of the invention, the return fluid from the opposite end of the lift jack 30, not connected with the pressurized inlet passage 146, is allowed to flow to either of a pair of return annuli 178 and 180 when the valve spool 154 is axially displaced from its central position. In such instances one of the return annuli communicates with a return passage 182 within the valve body 140 to permit fluid to be delivered to a conduit 184 leading to the primary control valve 54 as shown in FIG. 1. This advantageously permits a substantial portion of the flow from the small pump 52 to be utilized to supplement the flow from the large pump 50 for faster actuation of the lift jacks 28.

Figure 5:
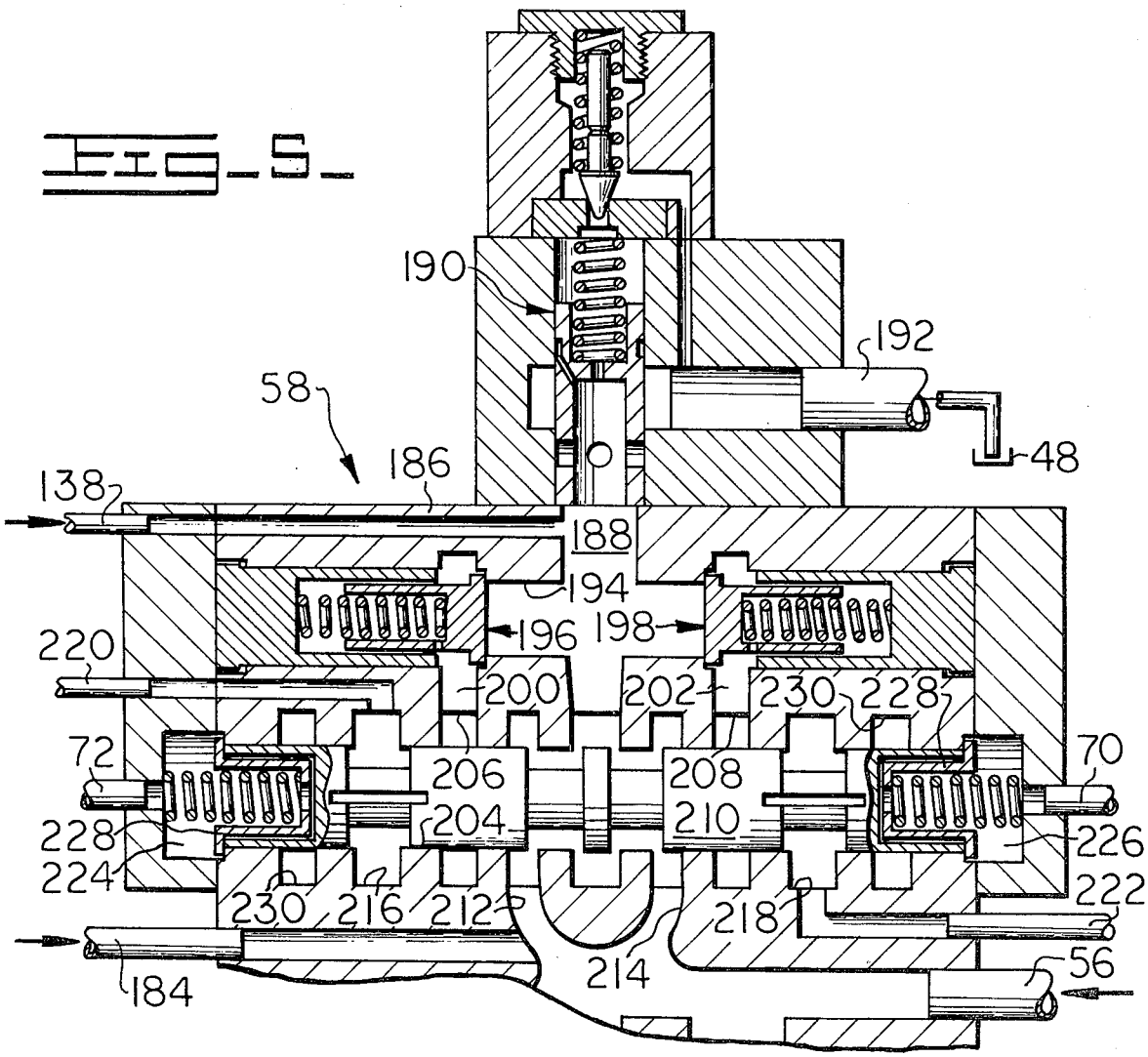
FIG. 5 is an enlarged sectional view of the pilot operated second control valve illustrated in FIG. 1 showing details of its construction.

Referring first to FIG. 1 and then to FIG. 5, it is to be noted that the branch conduit 138 from the flow divider 132 communicates the other half of the flow from the small pump 52 to a valve body 186 of the second control valve 58 by way of a branched inlet passage 188 formed therein. While a pilot operated relief valve 190 is illustrated in greater detail in FIG. 5, it is substantially the same as the previously mentioned conventional relief valve 148 associated with the third control valve 60, and is set to relieve pressure in excess of 2700 psi, for example, in the inlet passage back to the reservoir 48 via a drain line 192. The inlet passage opens on a bore 194 and a pair of load check valves 196 and 198 are individually mounted between the opposite ends of the bore and a pair of inlet passages 200 and 202 formed in the valve body. The inlet passages are subsequently in fluid communication with a spool bore 204 by way of a first inlet annulus 206 and a second inlet annulus 208. These load check valves permit flow from the bore 194 to the passages, but block flow in the reverse direction. An open center type valve spool 210 is axially slidably disposed within the bore 204 and in the position illustrated is adapted to permit fluid communication between the bore 194 and a pair of passages 212 and 214. Since the passages 212 and 214 are directly connected to the inlet conduit 56 from the large pump 50, half of the flow from the small pump is utilized for flow supplementing purposes.

More particularly, the valve body 186 of the second control valve 58 includes a first outlet annulus 216 and a second outlet annulus 218 which are disposed in essentially symmetrically arranged predetermined positions axially outwardly of the inlet annuli 206 and 208, respectively. These outlet annuli are respectively connected to the head end and rod end of the tilt jack 32 through a conduit 220 and a conduit 222. A pair of pressure chambers 224 and 226 are formed in the valve body at the opposite ends of the spool bore 204 and are in selective fluid communication with the pilot lines 72 and 70, respectively. While each of these chambers contains a spring-loaded device 228 for biasing the spool toward its central position, any piloting pressure supplied to the chambers still acts substantially on the full area of the end of the spool to move it laterally for supplying fluid to either end of the tilt jack 32 from the inlet passage 188. Further, a pair of exhaust annuli 230 are oppositely disposed adjacent each of the outlet annuli in order to allow fluid flow from the retracting end of the jack to return to the reservoir 48. Such construction is generally similar to that described in U.S. Pat. application Ser. No. 496,477 mentioned heretofore.

OPERATION OF THE BASIC EMBODIMENT

While the operation of the present invention is believed clearly apparent from the foregoing description, further amplification will subsequently be made in the following brief summary of such operation.

TIP FORWARD

When the tip control lever 44 shown in FIGS. 1 and 3 is positioned arcuately into the tip forward mode of operation, the dual lever control mechanism 14 moves the valve spool 66 of the first control device 62 upwardly when viewing the drawing, and also triggers or actuates the electric switch 80 of the second control device 64. In the first instance, movement of the valve spool positions the pilot control valve 68 to allow pilot signal pressure in the branch conduit 130 to be communicated with the pilot line 72. As shown in FIG. 5, pressurizing of the pilot line 72 also causes pressurizing of the chamber 224 and, subsequently, rightward movement of the valve spool 210. Since half of the flow of the small pump 52 is communicated to the branch conduit 138 via the flow responsive valve 92 and the flow divider 132, such flow is present at the load check valves 196 and 198. With rightward movement of the valve spool open fluid communication is permitted between the first inlet annulus 206 and the first outlet annulus 216 via the spool bore 204, while at the same time the second inlet annulus 208 is still blocked by the spool. Consequently, the left load check valve 196 opens to permit fluid communication to the inlet passage 200, and thus through the spool bore to the conduit 220 leading to the head end of the tilt jack 32. Simultaneously, the rod end of this tilt jack is arranged in open communication with the reservoir 48 through the conduit 222, the second outlet annulus 218, the spool bore and the exhaust annulus 230.

With extension of the right tilt jack 32 as mentioned above, the left tilt jack 30 also extends with the triggering of the electrically operated switch 80 of the second control device 64. With the triggering of this switch the first signal line 86 is caused to communicate an electric signal from the electric source 82 to the first solenoid valve 84 of the third control valve 60. As best shown in FIG. 4, this permits pilot pressure in the conduit 126 to be communicated to the pressure chamber 166. This biases the valve spool 154 rightwardly when viewing the drawing to permit the other half of the small pump flow, and present in the inlet conduit 136, to be directed through the load check valve 150, the inlet annulus 152, the bore 144, and the first outlet annulus 170 to the conduit 174 leading to the head end of the tilt jack 30. Rather than returning directly to the reservoir 48, however, the escaping flow from the rod end of the tilt jack is communicated to the primary control valve 54 by way of the conduit 176, the second outlet annulus 172, the bore, the return annulus 180, the return passage 182 and the conduit 184. Such flow thereupon serves to supplement the flow in the inlet conduit 56 so that upon actuation of the primary control valve, the lift jacks 28 can be actuated more responsively for fast elevational positioning of the bulldozer blade 24.

Thus, it can be appreciated that manually moving the first control lever 44 to its tip forward mode of operation will simultaneously extend both of the tilt jacks 30 and 32 in a coordinated manner, and to thereby pivot the bulldozer blade 24 about the transverse axis 36 as is clearly apparent from FIG. 2. In accordance with one feature of the present invention, this is achieved without affecting the tilt of the blade, provided neither tilt jack has reached the end of its stroke.

TIP REARWARD

In much the same way, manually moving the first control lever 44 to its opposite or tip rearward mode of operation causes downward movement of the valve spool 66 when viewing FIG. 1 through the first control device 62, and at the same time actuation of the second control device 64 through triggering of the electrical switch 78. The pilot control valve 68 is thus positioned to permit the pilot pressure in the conduit 130 to be communicated to the pilot line 70 and to the right end of the valve spool 210 within the second control valve 58 as illustrated in FIG. 5. This positions the valve spool leftwardly within the spool bore 204 and permits half of the flow of small pump 52 to be delivered through the load check valve 198, the inlet passage 202, the second inlet annulus 208, the bore 204 and the second outlet annulus 218 to be delivered to the rod end of the tilt jack 32 through the conduit 222. In a manner substantially opposite to that described above, the head end of this tilt jack is at the same time communicated to the reservoir 48 via the conduit 220, the first outlet annulus 216, the spool bore, and the exhaust annulus 230.

The left tilt jack 30 is also caused to retract since actuation of the switch 78 causes an electric signal to be delivered by the second signal line 90 to the second solenoid valve 88. Upon actuation of this solenoid valve, as best shown in FIG. 4, pressure is communicated from the pilot branch conduit 128 to the pressure chamber 168 so that the valve spool 154 is positioned leftwardly by the pilot pressure. Half of the flow from the small pump is subsequently directed through the inlet conduit 136, past the check valve 150, the inlet annulus 152, and the bore 144, so that pressure is available in the second outlet annulus 172. Consequently, this pressure is directed to the rod end of the tilt jack 30 through the conduit 176. Thus, because the flow divider 132 equally divides the flow from the small pump 52 to the branch conduits 136 and 138, both of the tilt jacks are retracted, or extended as the case may be, in the same coordinated manner without the tilt of the bulldozer blade 24 being affected, unless one of the tilt jacks has reached the end of its stroke.

TILT LEFT

With forward arcuate movement of the second control lever 46, as shown in FIG. 3, to its tilt left mode of operation, the dual lever control mechanism 14 illustrated in FIG. 1, is caused to move the valve spool 66 of the pilot control valve 68 upwardly through the first control device 62, and also to actuate the switch 76 of the second control device 64. As stated above, with respect to the tip forward mode of operation, upward movement of this spool causes a pilot signal to be delivered through the pilot line 72 whereupon the second control valve 58 is axially displaced for communicating pressure to the head end of the tilt jack 32 through the conduit 220. On the other hand, triggering of the switch 76 causes actuation of the second solenoid valve 88 to allow pilot displacement of the third control valve 60 and fluid communication to the rod end of the left tilt jack 30 through the conduit 176 substantially as described above with respect to the tip rearward mode of operation.

Consequently, in the tilt left mode of operation, the right tilt jack 32 extends while the left tilt jack 30 retracts so that both jacks move in opposite directions.

As a result, the left side of the bulldozer blade 24 is moved quickly and responsively downwardly when viewing FIG. 2, with the blade substantially rotating in a counterclockwise manner about the longitudinal axis 34.

TILT RIGHT

Upon movement of the second control lever 46 arcuately to its tilt right mode of operation, the selector spool 66 is caused to move downwardly when viewing FIG. 1 by the first control device 62, while at the same time the electric switch 74 is actuated by the second control device 64 to permit actuation of the first solenoid valve 84. In a manner substantially as described above, this permits the second control valve 58 to pressurize the rod end of the right tilt jack 32 through the conduit 222 in order to retract it, while the third control valve 60 is actuated to deliver fluid to the conduit 174 to the head end of the left tilt jack 30 to extend it.

As is apparent when visualizing FIG. 2, the retraction of the right tilt jack 32 and simultaneous extension of the left jack 30 causes relatively rapid clockwise movement of the bulldozer blade 24 around the longitudinal axis 34 so that the right side of the bulldozer blade is moved downwardly with respect to the left jack.

In accordance with another aspect of the invention, even though one of the tilt jacks 30 or 32 is at the end of its stroke and thus causing either of the relief valves 148 or 190 to relieve pressure therefrom, the other of the tilt jacks is still movable because it is supplied fluid independently from the flow divider 132. Therefore, the hydraulic control system of the present invention advantageously permits tilting of the bulldozer blade 24 from a fully tipped condition, and tipping thereof from a fully tilted condition, though the latter action would result in affecting the angle of tilt of the blade.

ALTERNATE EMBODIMENT

Figure 6:
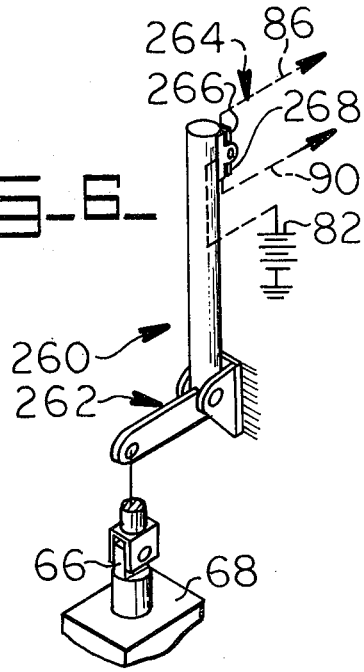
FIG. 6 is a fragmentary perspective elevational view of an alternate embodiment control mechanism which can be utilized with the hydraulic control system of FIG. 1

It is, of course, contemplated that it is not necessary to incorporate the dual lever control mechanism 14 in order to operate the hydraulic control system of the present invention, though its construction, which is disclosed in the aforementiond U.S. Pat. application Ser. No. 595,820, has certain operational advantages in simultaneously positioning both of the tilt jacks 30 and 32. For example, the valve spool 66 of the pilot control valve 68 may be independently manipulated for direct control of the second control valve 58 of FIG. 1 without actuation of the third control valve 60. As is schematically illustrated in FIG. 6, an alternate embodiment control mechanism 260 includes a movable ball-crank shaped control lever or first control device 262 suitably connected to the valve spool 66. In a manner similar to that described above with respect to the basic embodiment, movement of the valve spool upwardly or downwardly when viewing the drawing away from the position shown will respectively cause extension or retraction of the right tilt jack 32. On the other hand, the alternate control mechanism includes a three-position electrical switching apparatus or totally independent second control device 264 which is conveniently mounted on the control lever 262. By manually depressing either one of a pair of switches 266 and 268 of the second control device, electrical signals are respectively communicated to the signal lines 86 or 90 from the electrical source 82. Subsequently, these signals actuate the first or second solenoid valves 84 and 88 which are associated with the third control valve of FIG. 1 for respectively allowing extension or retraction of the other tilt jack 30. It is thus clearly apparent that the alternate embodiment control mechanism 260 will allow independent movement of both of the tilt jacks 30 and 32 through the completely separate manual manipulation of the control devices 264 and 262, respectively.

A feature of the alternate independent control devices 262 and 264 is that they may be operated together to give two speeds of tilt. Either the first control device 262 can be moved alone to allow individual retraction or extension of the right tilt jack 32, or can be moved aong with actuation of the second control device to cause simultaneous extension or retraction of the left tilt jack 30. Of course, the latter situation would result in tilting of the blade much more rapidly than the former.

Another advantage of the alternate embodiment is that the operator has the opportunity to release one of the simultaneously actuated control devices 262 and 264 should he visually observe that one of the tilt jacks 30 or 32 has reached the end of its stroke. This action will reduce the amount of heat going into the control system and otherwise resulting from exhausting to the reservoir 48 through one of the relief valves 148 or 190.

While the present invention has been described and shown with particular reference to two embodiments, it will be apparent that other variations might be possible that would fall within the scope of the present invention, which is not intended to be limited except as defined in the following claims.

What is claimed is:

1. A hydraulic control system, for selectively directing fluid to a pair of reciprocable jacks connectably disposed intermediate a frame and an implement for tilting and tipping the implement relative to the frame, comprising;

a fluid supply source;

a flow divider valve in fluid communication with said fluid supply source for providing equal fluid flow to a pair of outlet paths;

first control valve means including a control valve for selectively communicating fluid from one of said outlet paths to either end of one of said jacks; and second control valve means including an electrically actuated, hydraulically pilot operated control valve for selectively communicating fluid from the other one of said outlet paths to either end of the other one of said jacks.

2. A hydraulic control system, comprising;

a fluid supply source;

a primary pump connected to said source;

a second pump connected to said source;

a primary motor;

a first auxiliary motor;

a second auxiliary motor;

primary control valve means for selectively communicating fluid from said primary pump to said primary motor for operation thereof;

means for dividably directing fluid from said secondary pump to a pair of fluid paths;

second control valve means operatively associated with one of said paths for selectively communicating flow therein to said first auxiliary motor; and third control valve means operatively associated with the other of said paths for selectively communicating flow therein to said second auxiliary motor, said third control valve means having an outlet passage communicating any excess fluid to said primary control valve means for supplementing the flow from said primary pump.

3. A hydraulic control system, for selectively varying the lift, tilt and tip positions of an implement pivotally supported on a vehicle, comprising;

a fluid supply source;

a primary pump communicating with said source;

a secondary pump communicating with said source;

lift motor means for raising and lowering such implement relative to the vehicle;

first and second motor means for tilting and tipping said implement relative to the vehicle;

primary control valve means for selectively communicating fluid from said primary pump to said lift motor means for raising and lowering of said implement;

means for dividably directing fluid from said secondary pump to a pair of fluid passages;

second control valve means operatively coupled with one of said passages for selectively communicating flow therein to said first motor means; and third control valve means operatively coupled with the other one of said passages for selectively communicating flow therein to said second motor means, said third control valve means having an outlet passage communicating any excess fluid to said primary control valve means for supplementing the flow from said primary pump.

4. A hydraulic control system, for selectively varying the elevation, tilt and tip positions of an earth-moving implement including a frame pivotally supported on a vehicle and a bulldozer blade pivotally mounted on the frame, comprising;

a fluid supply source;

a pair of positive displacement pumps of different volumetric capacities to define a large pump and a small pump which are in fluid communication with said source;

a lift jack mounted intermediate said implement and the vehicle for raising and lowering it;

a pair of tilt jacks mounted intermediate said frame and said blade for tilting and tipping said blade relative to the vehicle;

primary control valve means for selectively communicating fluid from said large pump to said lift jack for operation thereof;

a divider valve in fluid communication with said small pump for providing equal fluid flow to a pair of fluid passages;

second control valve means in fluid communication with one of said passages for selectively directing flow therein to one of said tilt jacks; and third control valve means in fluid communication with the other of said passages for selectively directing flow therein to the other one of said tilt jacks, said third control valve means having an outlet passage communicating any excess fluid to said primary control valve means for supplementing the flow from said primary pump.

* * * * *